US009506673B2

(12) United States Patent
Spooner et al.

(10) Patent No.: US 9,506,673 B2
(45) Date of Patent: Nov. 29, 2016

(54) CONTAINER

(71) Applicant: The Hymatic Engineering Company Limited, Bracknell, Berkshire (GB)

(72) Inventors: Scott Spooner, Bromsgrove (GB); Chun Fai Cheuk, Redditch (GB)

(73) Assignee: THE HYMATIC ENGINEERING COMPANY LIMITED, Bracknell, Berkshire (GB)

( * ) Notice: Subject to any disclaimer, the term of this patent is extended or adjusted under 35 U.S.C. 154(b) by 80 days.

(21) Appl. No.: 14/150,066

(22) Filed: Jan. 8, 2014

(65) Prior Publication Data

US 2014/0190186 A1 Jul. 10, 2014

(30) Foreign Application Priority Data

Jan. 9, 2013 (GB) ..... 1300356.1

(51) Int. Cl.

| | |
|---|---|
| ***F17C 3/10*** | (2006.01) |
| ***F25B 9/14*** | (2006.01) |
| ***F17C 1/00*** | (2006.01) |

(52) U.S. Cl.

CPC ..... *F25B 9/145* (2013.01); *F17C 1/00* (2013.01); *F17C 2201/0119* (2013.01); *F17C 2223/0161* (2013.01); *F17C 2227/0353* (2013.01)

(58) Field of Classification Search

CPC ..... F25B 2309/1415; F25B 2309/003; F25B 9/14; F25B 9/145; F25B 2345/002; F25B 2345/004; F25B 9/02; F28D 7/02; F28D 7/022; F28D 7/024; F28D 7/026; F28D 7/028; F17C 2227/0376; F17C 2227/0379; F17C 2227/0381; F17C 2203/0617; F17C 2227/0339; F17C 3/10

USPC ..... 62/51.1, 51.2; 220/560.04

See application file for complete search history.

(56) References Cited

U.S. PATENT DOCUMENTS

| | | | | |
|---|---|---|---|---|
| 1,863,958 | A * | 6/1932 | Wulff et al. | 62/46.1 |
| 3,304,728 | A * | 2/1967 | De Haan | 62/48.3 |
| 3,698,200 | A * | 10/1972 | Johnson et al. | 62/50.2 |
| 5,966,943 | A * | 10/1999 | Mitchell | 62/6 |
| 6,463,757 | B1 * | 10/2002 | Dickson et al. | 62/503 |
| 6,505,469 | B1 * | 1/2003 | Drube et al. | 62/48.1 |
| 2006/0086099 | A1 * | 4/2006 | Dickerson | F25J 1/0017 62/47.1 |

(Continued)

FOREIGN PATENT DOCUMENTS

| | | |
|---|---|---|
| CN | 102032703 A | 4/2011 |
| CN | 102147048 A | 8/2011 |

(Continued)

OTHER PUBLICATIONS

UK Search Report dated Jun. 13, 2013.

*Primary Examiner* — Frantz Jules
*Assistant Examiner* — Erik Mendoza-Wilkenfe
(74) *Attorney, Agent, or Firm* — Shimokaji IP

(57) ABSTRACT

A container is described having a wall with a thickness defined by inner and outer surfaces, said inner surface defining an internal cavity for receiving fluid, the container having an opening through which fluid can enter/exit the container, said opening being connected to a fluid conduit at least a length of which extends through the wall in between the inner and outer surfaces thereof which exits through the inner surface to communicate with the internal cavity. Also described is a pulse tube refrigerator/cryocooler system including such a container.

21 Claims, 3 Drawing Sheets

(56) References Cited

U.S. PATENT DOCUMENTS

| | | | | |
|---|---|---|---|---|
| 2008/0105691 | A1* | 5/2008 | Schlag | 220/581 |
| 2009/0107150 | A1* | 4/2009 | Yuan et al. | 62/6 |
| 2014/0069115 | A1* | 3/2014 | Bellis et al. | 62/6 |

FOREIGN PATENT DOCUMENTS

| | | | |
|---|---|---|---|
| JP | 2005037015 | A | 2/2005 |
| JP | 2006017422 | A | 1/2006 |

* cited by examiner

CONTAINER

BACKGROUND OF THE INVENTION

This invention relates to a container. More particularly, but not exclusively, this invention relates to a container for receiving and storing a gas which is intended to be used as part of a pulse tube refrigerator (often known as a "cryocooler"). The container can be utilised in other applications outside the field of cryocoolers, for storing fluids.

The general function of a pulse tube cryocooler is well known to one skilled in the art, and generally includes the following features/components:

a) a piston and cylinder assembly for effecting cyclical movement of gas (e.g. Helium);

b) a regenerator for storing and recovering thermal energy of the gas moving cyclically in that direction as a result of the piston;

c) a pulse tube fluidly connected to the regenerator, acting as an insulator between the regenerator and the remainder of the cryocooler;

d) an inertance tube offering restriction and inertial effect to the cyclically moving gas, fluidly connected to the pulse tube; and e) a container (often referred to as a "reservoir") fluidly connected to the inertance tube, for storing a volume of gas. The combined effect of the inertance tube and the reservoir shifts the phase of the cyclical pressure relative to the mass flow.

The function of the cryocooler is to provide cooling to a device, particularly cryogenic temperatures. The present invention has been devised to achieve temperatures lower than 80K.

According to a first aspect of the present invention, we provide a container having a wall with a thickness defined by inner and outer surfaces, said inner surface defining an internal cavity for receiving fluid, the container having an opening through which fluid can enter/exit the container, said opening being connected to a fluid conduit at least a length of which extends through the wall in between the inner and outer surfaces thereof which exits through the inner surface to communicate with the internal cavity.

According to a second aspect of the present invention, we provide a pulse tube refrigerator/cryocooler system including a container according to the first aspect of the present invention.

Further features of the various aspects of the invention are set out in the claims attached hereto.

BRIEF DESCRIPTION OF THE DRAWINGS

Embodiments of the invention will now be described by way of example only with reference to the accompanying drawings, of which.

DETAILED DESCRIPTION OF THE INVENTION

Figure 1:
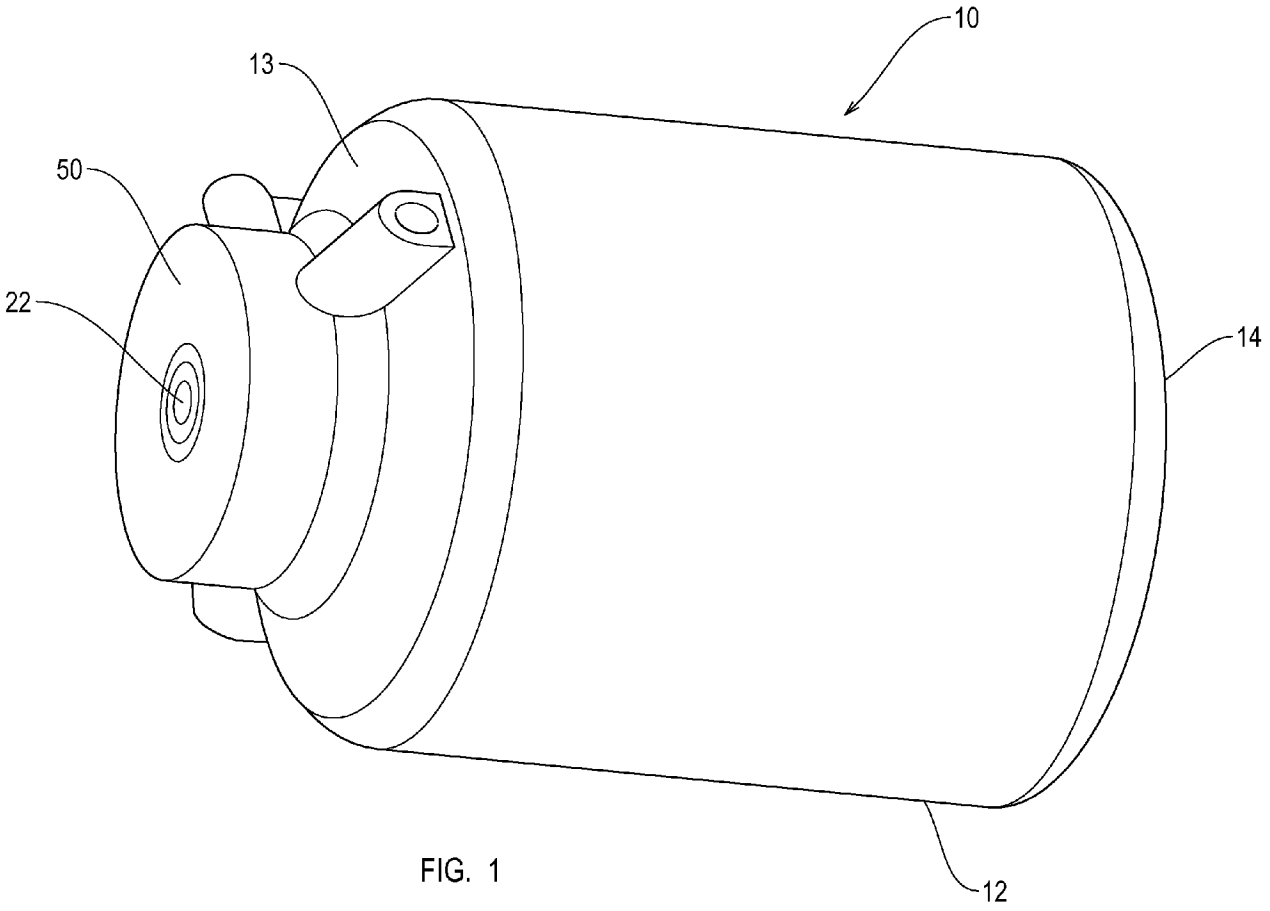
FIG. 1 is a perspective view of a first embodiment of a container according to the present invention.
Figure 2:
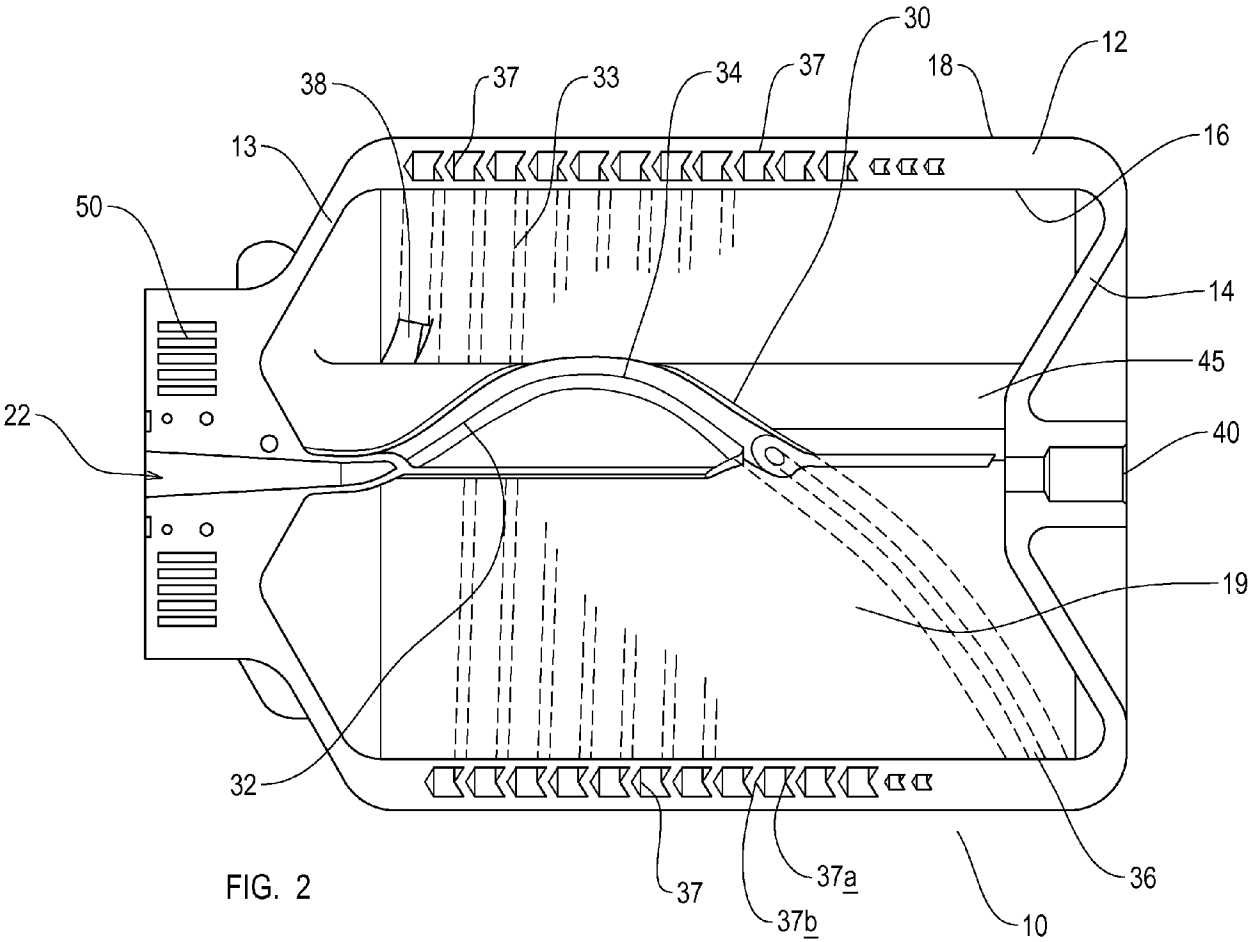
FIG. 2 is a cross-sectional view axially through the container of FIG. 1.

I refer firstly to FIGS. 1 and 2, these show a first embodiment of a container in accordance with the present invention, generally at 10. The container 10 in this embodiment is a container for use as a "reservoir" in a pulse tube cryocooler (not shown) system for storing the volume of gas, e.g. helium, substantially at a constant pressure. Advantageously, the container 10 in accordance with the present invention has an integral inertance tube. In contrast to prior art cryocooler systems, the invention is compact and has other advantages, such as reducing and/or nearly eliminating vibration of the inertence tube in use due to its positioning within the wall of the container.

FIG. 2 is a perspective view of the container 10 in which it can be seen that the container is generally cylindrical and has a cylindrical wall 12 which is closed at one end by a first end wall 13 and at an opposite end a second wall 14. The container also advantageously includes a heat sink 50 connected to or forming part of the first end wall 13.

As shown in more detail in FIG. 2, the container 10 has a wall 12 with a wall thickness defined by inner 16 and outer 18 surfaces. The inner surface 16 defines an internal cavity 19 for receiving and holding fluid, which in example of a cryocooler would be an inert gas, such as helium. The container 10 has an opening 22 positioned generally centrally in the first end wall 13, which extends through the heat sink 50. The opening 22 is substantially coaxial with an axis of the container 10 and tapers towards that axis as it extends inwardly towards and into the internal cavity 19. The opening 22 permits fluid (in this example gas) to enter and exit the container. In practice, when a container 10 forms part of a pulse tube cryocooler system the outwardly facing surface of the heat sink 50 is connected to a pulse tube, regenerator and piston, which effects cyclical movement of gas into and out from the opening 22.

The opening 22 is connected to a fluid conduit 30 which provides the function of the "inertence tube". The conduit 30 extends into the internal cavity 19 where it is supported by a support member 45. The support member 45 is a baffle/web of material which is connected at its opposite ends to the first and second end walls 13, 14 and along its length to the inner surface of the wall 12. The purpose of the support member 45 is two fold. Firstly, it provides support for the fluids conduit 30, but also provides additional rigidity to the container 10.

As can be seen from the Figures the fluid conduit 30 has a first portion 32, positioned inside the internal cavity 19, which extends towards the inner surface 16 of the wall 12 (e.g. away from the axis of the container). When it reaches the surface 16 it changes direction and stays in contact with the inner surface 16 as it spirals downwardly towards the second end wall 14 (see the dashed lines in FIG. 2). When it reaches the second end wall 14 the conduit 30 extends, at 36, through the inner surface 16 and into the wall thickness. Once inside the wall thickness, between the inner and outer surfaces 16, 18, the fluid conduit 30 extends through the wall 12 peripherally around the container 10 in a substantially helical form whilst travelling from the end of the container 10 adjacent the second end wall 14 towards the first end wall 13. As the fluid conduit 30 nears the first end wall 13 it exits through the inner surface 16 to communicate with the internal cavity 19 (see reference 38 in FIG. 2).

Thus, the fluid conduit 30 enters the wall thickness at one end of the container 10 by extending through the inner surface 16 of the wall 12 at 36 and exits the wall thickness at an opposite end of the container 10 by extending through the inner surface 16 of the wall 12.

As shown in FIG. 2 the container 10 includes a further, closeable, opening 40 which connects the internal cavity 19 to atmosphere. The purpose of the further opening 40 is to provide a means for "charging" the cavity 19 with gas, e.g. helium in order to pre-pressurise the system, and thus the cryocooler system prior to use.

As can be seen from the cross-sectional view in FIG. 2, the fluid conduit 30 extending through the wall thickness provides a plurality of cross-sectional profiles 37 which in the present example are nested relative to each other. By nesting we mean that the profiles 37 are closely positioned adjacent each other in order to minimise wastage of a material therebetween, but whilst maintaining enough material for structural rigidity.

In the present example the profile 37 provided by the fluid conduit 30 has a receiving portion 37*a* and an extension portion 37*b*. The purpose of the receiving and extension portions 37*a,b* are to ensure that the receiving portion of one length of fluid conduit 30 can receive the extension portion of an adjacent length of a fluid conduit 30. In this way adjacent sections of the fluid conduit 30 can be closely nested relative to each other in the wall thickness, thus minimising material wastage and maximising the length and volume of the fluid conduit 30 provided within the wall thickness of the container 10.

Figure 3:
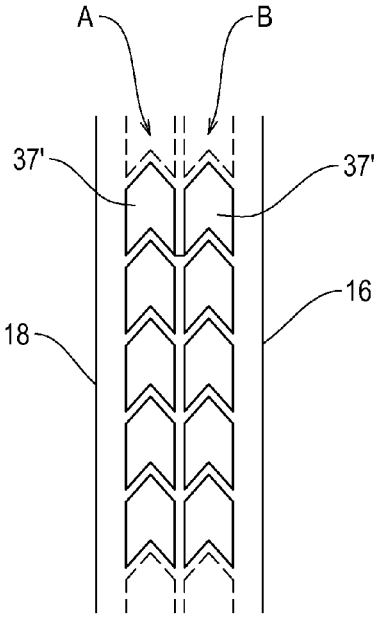
FIG. 3 is a cross-sectional view through a wall of a second embodiment.
Figure 5:
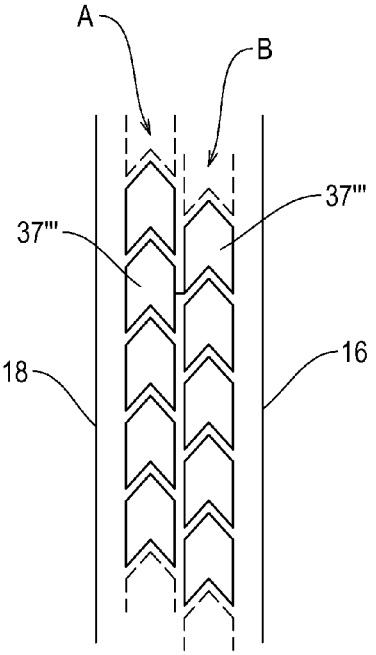
FIG. 5 is a cross-sectional view through a wall of a fourth embodiment.

FIGS. 3 and 5 show alternative embodiments of the path of the fluid conduit as it extends through the wall thickness between the inner 16 and outer 18 surfaces. The profiles 37' 37" in these embodiments are substantially identical to those in the first embodiment (FIG. 2) but here the fluid conduit 30 extends in two (inner and outer) paths as it extends from one end of the container 10 towards the opposite end of the container. This permits a greater length and volume of fluid conduit to be provided within the wall thickness. It should be appreciated that the internal path of the fluid conduit 30 in the embodiments shown in FIGS. 3 and 5 could travel from one end of the container towards the other end along the inner track of profiles 37', 37" and then in an opposite direction along the outer track of profiles 37', 37" (or vice versa). The main difference between the embodiments shown in FIGS. 3 and 5 is that in FIG. 5 the profiles 37" are offset from each other in the adjacent inner and outer paths.

Figure 4:
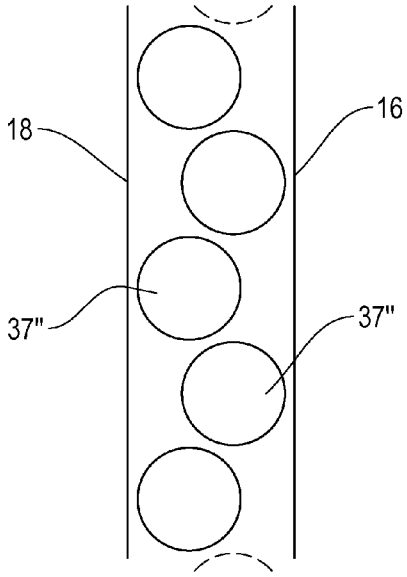
FIG. 4 is a cross-sectional view through a wall of a third embodiment.

FIG. 4 shows a further alternative embodiment in which the profile 37" of the fluid conduit is circular or substantially circular (it could also be oval). Here the profiles of adjacent sections of the fluid conduit 30 are offset from each other. In other words a first section is positioned closer to the inner surface 16, whilst an adjacent section is positioned closer to the outer surface 18. It should be appreciated, of course, that the profiles 37" could be provided in an aligned configuration along an axis substantially parallel with one or other of the inner or outer surfaces 16, 18.

Various modifications can be made to the embodiments described above without departing from the present invention. For example, whilst in the embodiments the fluid conduit follows a helical path, it is not necessary for it to do so. For example, the fluid conduit could extend in multiple linear paths which repeatedly extend between the first and second end walls and back again. Alternative paths of the fluid conduit could also be used so long as they extend through the wall thickness and exit into the internal cavity.

In addition, the fluid conduit may taper, or alter in cross-sectional shape, as it extends through the wall of the container. The fluid conduit may be positioned closer to the inner surface of the wall than it is to the outer surface of the wall. Alternatively, the fluid conduit may be positioned closer to the outer surface of the wall than it is to the inner surface of the wall. In each of these configurations a thicker section of wall (either adjacent the inner surface or adjacent the outer surface) is provided to improve the structural strength of the container.

It is envisaged that the container in accordance with the present invention could be manufactured by fabrication, rapid prototyping techniques, direct metal laser sintering, investment or other casting techniques, injection or compression moulding or machining. However, it has been found that direct metal laser sintering and rapid prototyping provide a desirable end product in terms of structural strength and sealing (i.e. so no loss of gas from the system or between adjacent sections of the fluid conduit).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

We claim:

1. A container comprising:

an internal cavity for receiving fluid;

a single layer wall surrounding the cavity, the single layer wall being formed from wall material with an inner surface and an outer surface;

an opening through which fluid can enter/exit the container; and a fluid conduit formed within the wall material between the inner and outer surfaces thereof; and wherein the fluid conduit is connected to the opening, enters an interior of the single layer wall through the inner surface of the single layer wall and exits through the inner surface of the single layer wall to communicate with the internal cavity.

2. A container according to claim 1 wherein the container includes a support member positioned within the internal cavity for supporting a portion of the fluid conduit.

3. A container according to claim 1 wherein the container includes a support member positioned within the internal cavity for supporting a portion of the fluid conduit adjacent the opening to the container.

4. A container according to claim 2 wherein the support member is connected to the wall of the container.

5. A container according to claim 2 wherein the support member extends along the inner surface of the single layer wall.

6. A container according to claim 1 wherein the fluid conduit is embedded in the single layer wall peripherally around the container.

7. A container according to claim 1 wherein the fluid conduit extends helically within the single layer wall from one end of the container towards an opposite end of the container.

8. A container according to claim 1 wherein the fluid conduit is formed as an empty space within the wall material.

9. A container according to claim 1 wherein the fluid conduit enters the interior of the single layer wall at one end of the container by extending through the inner surface of the single layer wall and exits the interior of the single layer wall at an opposite end of the container by extending through the inner surface of the single layer wall.

10. A container according to claim 1 wherein a first portion of the fluid conduit adjacent the opening to the container extends into the internal cavity and towards the single layer wall.

11. A container according to claim 10 wherein a second, adjacent, portion of the fluid conduit extends along and is connected to the inner surface of the single layer wall before extending through the inner surface thereof and into the integral interior of the single layer wall.

12. A container according to claim 11 wherein the second portion of the fluid conduit extends peripherally around the inner surface of the single layer wall as it extends away from the opening to the container.

13. A container according to claim 12 wherein the second portion of the fluid conduit is helical or part helical.

14. A container according to claim 1 wherein the inner surface of the single layer wall through which the fluid conduit extends is cylindrical.

15. A container according to claim 14 wherein the container has first and second end walls connected to the single layer wall at respective opposite ends thereof.

16. A container according to claim 15 wherein the opening to the container passes through the first end wall.

17. A container according to claim 1 wherein the container includes a further, closable, opening which connects the internal cavity to atmosphere.

18. A container according to claim 1 wherein adjacent lengths of the conduit within the single layer wall are nested.

19. A pulse tube refrigerator/cryocooler system including a container that comprises:

an internal cavity for receiving fluid;

a single layer wall surrounding the cavity, the single layer wall being formed from wall material with an inner surface and an outer surface;

an opening through which fluid can enter/exit the container; and a fluid conduit formed within the wall material between the inner and outer surfaces thereof;

wherein the fluid conduit is connected to the opening, enters an interior of the single layer wall through the inner surface of the wall and exits through the inner surface of the single layer wall to communicate with the internal cavity.

20. A pulse tube refrigerator/cryocooler system according to claim 19 whereby the rigidity of the fluid conduit within the wall of the container results in lowering and/or eliminating vibration during use.

21. A pulse tube refrigerator/cryocooler system according to claim 19 wherein the fluid conduit is formed as an empty space within the wall material.

* * * * *